United States Patent [19]

Weiss et al.

[11] Patent Number: 4,798,297

[45] Date of Patent: Jan. 17, 1989

[54] MERCHANDISING SYSTEM FOR PAINT BRUSHES AND THE LIKE

[75] Inventors: Robert L. Weiss, Wooster; Charles Jentes, Smithville; Richard J. Crowell, Wooster, all of Ohio

[73] Assignee: The Wooster Brush Company, Wooster, Ohio

[21] Appl. No.: 636,735

[22] Filed: Aug. 1, 1984

[51] Int. Cl.[4] ..... A47B 81/02

[52] U.S. Cl. ..... 211/65; 211/59.1; 211/89

[58] Field of Search ..... 211/65, 59.1, 89, 60.1; 248/220.3, 222.2, 297.5; 206/362

[56] References Cited

U.S. PATENT DOCUMENTS

| | | | |
|---|---|---|---|
| 2,604,997 | 7/1952 | Pearson | 211/59.1 X |
| 2,952,364 | 9/1960 | Jacobson | 211/65 |
| 3,645,485 | 2/1972 | Gold | 211/59.1 X |
| 3,897,926 | 8/1975 | Silver . | |
| 4,025,018 | 5/1977 | Thalenfeld | 211/59.1 X |

FOREIGN PATENT DOCUMENTS

| | | | |
|---|---|---|---|
| 526644 | 3/1954 | Belgium | 211/65 |

*Primary Examiner*—Blair M. Johnson

*Attorney, Agent, or Firm*—Renner, Otto, Boisselle & Sklar

[57] ABSTRACT

A paint brush merchandising system characterized by a display hanger including a wire body bent intermediate its length at an acute angle to form a rear article storage portion and an angled front article display portion. Attachment means are provided at the rear end of the wire body for removable yet secure mounting to an upright panel such as an aperture panel with the storage portion extending substantially normal to the panel and the display portion at an upwardly inclined angle in the vertical plane of the storage portion. The display hanger also includes a covering of soft resilient material on the display portion over substantially the length thereof which covering is operative to effect a wedging or binding action at the handle hole of one or more paint brushes threaded thereon for holding such brushes upwardly tilted on the display portion for easy removal and viewing. Other brushes may be stored inwardly of the upwardly tilted brushes on the storage portion in vertical hanging disposition adjacent the panel and clear of the upwardly tilted brushes.

10 Claims, 1 Drawing Sheet

MERCHANDISING SYSTEM FOR PAINT BRUSHES AND THE LIKE

DISCLOSURE

The invention herein disclosed relates generally to a merchandising system for paint brushes and the like, characterized by a display hanger operative to store and display paint brushes or the like on an upright panel with the forwardmost or fronted paint brushes held upwardly inclined and aligned for easy viewing and removal.

BACKGROUND

In retail establishments such as paint stores, hardware stores, department stores, etc., paint brushes have been stored and displayed for sale by using wire hooks or brackets mounted to vertical aperture panels of display islands or wall assemblies. The wire hooks or brackets include an attachment end configured for removable securement to the aperture panel at an aperture or apertures therein and a straight wire portion which extends normal to the panel for vertical hanging support of the paint brushes at holes in their handles. The straight wire portions are of sufficient length to hold thereon a plurality of brushes typically of the same type and size in vertical disposition.

For efficient usage of display space, a common practice is to arrange the wire brackets in vertically spaced horizontal rows with the brackets in each row spaced apart to accommodate different widths of the brushes hung therefrom. The display is most attractive and effective when each bracket is filled or when the brushes are fronted, i.e., slid to the front ends of partially filled brackets as against a stop or short upturned end of the bracket. In either case, brushes in horizontal rows substantially below eye level are somewhat difficult to see because of their vertical disposition and resultant substantial angle to a viewer's downwardly directed line of sight.

Still another problem associated with the use of wire brackets of the foregoing type is the tendency of fronted brushes to be pushed back as brushes are removed and in many instances replaced after examination. This not only adversely affects the overall attractiveness of the display but may also result in pushed back brushes, particularly in the lower rows, being partly or completely hidden from normal view. Previously used wire brackets also have had potential for injury to customers and employees upon engagement with exposed ends of such brackets.

Another known paint brush merchandising system overcomes one or more of the aforenoted problems by employing a straight paint brush hanger of rectangular cross section which is supported at an upwardly inclined angle from an aperture panel by a bracket. Brushes provided with a specially formed keyhole slot in their handles may be slipped onto the hanger and held upwardly angled by a back rest member which may be adjusted along the hanger to front the paint brushes. One drawback with such a system is that paint brushes provided with the usually circular handle hole cannot be used therewith. Only paint brushes with a specially formed slot can be used. Other problems are the apparent added cost of the system and the potential for loss or misplacement of the back rest members.

SUMMARY OF THE INVENTION

The present invention provides an improved merchandising system for paint brushes and the like characterized by a display hanger which is highly functional yet inexpensive and easy to manufacture and use. The system and hanger provide for orderly storage and display of paint brushes and the like on an upright panel with the forwardmost brushes held upwardly inclined for easy viewing and removal.

Briefly, a display hanger according to the invention comprises a wire body bent intermediate its length at an acute angle to form a rear article storage portion and an angled front article display portion. Attachment means are provided at the rear end of the wire body for removable yet secure mounting to an upright panel such as an aperture panel with the storage portion extending substantially normal to the panel and the display portion at an upwardly inclined angle in the vertical plane of the storage portion. The display hanger also and importantly includes a covering of soft resilient material on the display portion over substantially the length thereof which covering is operative to effect a wedging or binding action at the handle hole of one or more paint brushes threaded thereon for holding such brushes upwardly tilted for easy removal and viewing. Other brushes may be stored inwardly of the upwardly tilted brushes on the storage portion in vertical hanging disposition adjacent the panel and clear of the upwardly tilted brushes.

As will be appreciated, the soft resilient covering eliminates the need for adjustable back rest members previously utilized to front and support brushes upwardly inclined for easy viewing and removal. The soft resilient covering, which preferably is a soft vinyl or rubber coating, also serves to keep the brushes hung thereon aligned for an attractive and orderly display as well as to protect customers and employees from injury. The display hanger, preferably being made of ductile metal wire or rod, may be adjusted by rebending the angle thereof on site to allow for different weight brushes, different sizes and shapes of handle holes, and variations in the aperture display panels or boards.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

DETAILED DESCRIPTION

Figure 1:
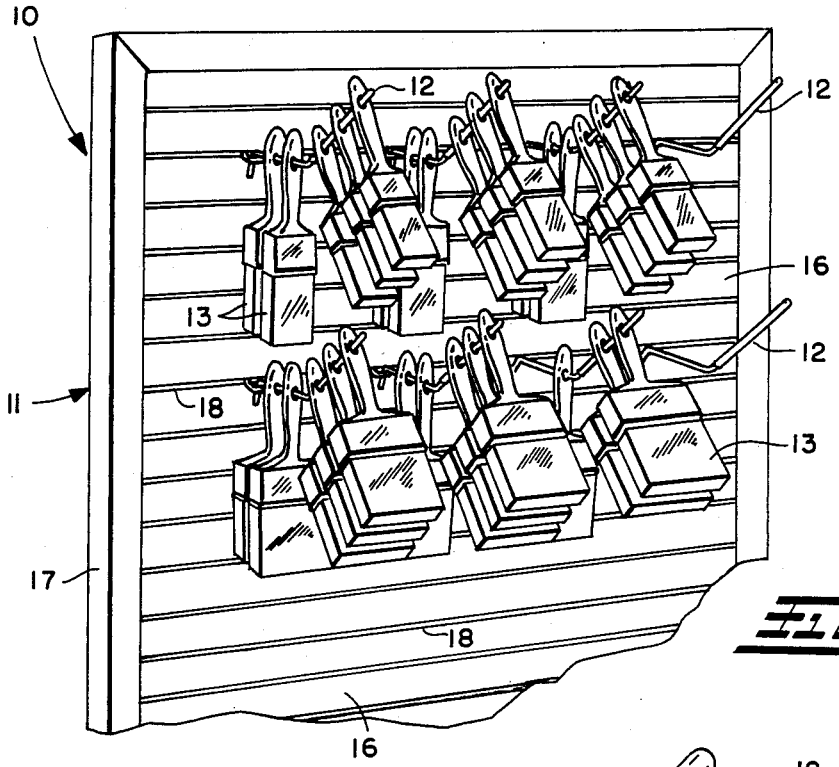
FIG. 1 is a fragmentary perspective view of a paint brush merchandising system according to the invention.

Referring now in detail to the drawings and initially to FIG. 1, a paint brush merchandising system according to the invention is indicated generally at 10. The system comprises an aperture panel or board 11, a plurality of display hangers 12 and a plurality of paint brushes 13 which may be of various sizes and types.

The aperture panel 11 may be of the pegboard type or the illustrated type including a plurality of horizontal slots 16 in a rectangular frame 17. The slats 16 are parallel and vertically spaced apart to form horizontal apertures or slots 18. The slots 18 may be equally vertically spaced apart and of equal length and height.

Figure 2:
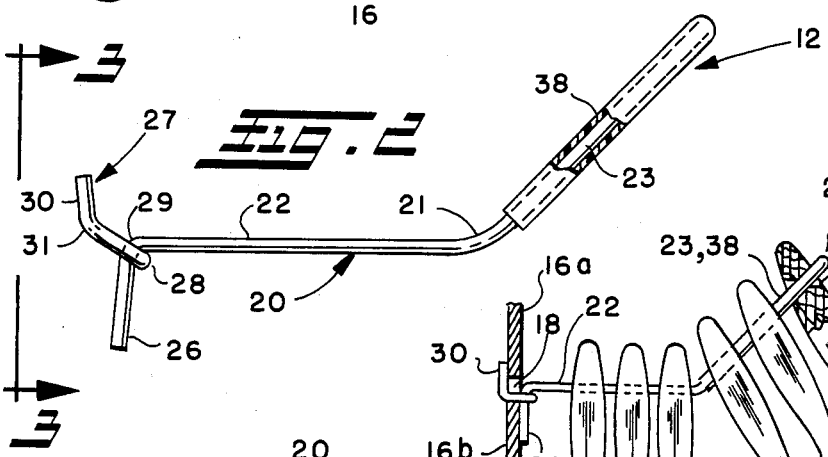
FIG. 2 is a side elevational view, partly broken away in section, of a display hanger employed in the system of FIG. 1.
Figure 3:
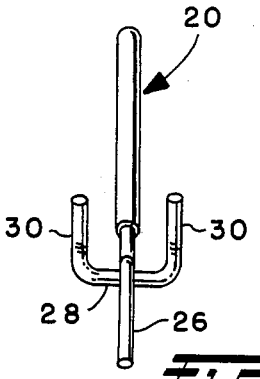
FIG. 3 is a rear end elevational view of the display hanger as viewed generally in the direction of the arrows 3—3 of FIG. 2.

As best seen in FIGS. 2 and 3, each display hanger 12, in accordance with the invention, comprises a rod or wire body 20 preferably of substantially uniform circular cross-section. The wire body 20 is bent intermediate its length at 21 to form a rear article storage portion 22 and an angled front article display portion 23 of about equal length.

At its rear end (at the left in FIG. 2), the wire body 20 terminates at a short leg 26 downwardly bent approximately perpendicular to the storage portion 22. A generally U-shape wire hook element 27 is attached as by welding at the midpoint of its bight portion 28 to the front side of the short leg 26 just beneath the storage portion 22 at the bend 29 therebetween. The substantially parallel leg portions 30 of the hook element 27 initially extend rearwardly at opposite sides of the short leg 26 at a slightly upwardly inclined angle to a bend 31 and then at a much greater angle approximating a right angle in relation to a longitudinal extension of the storage portion 22.

Figure 4:
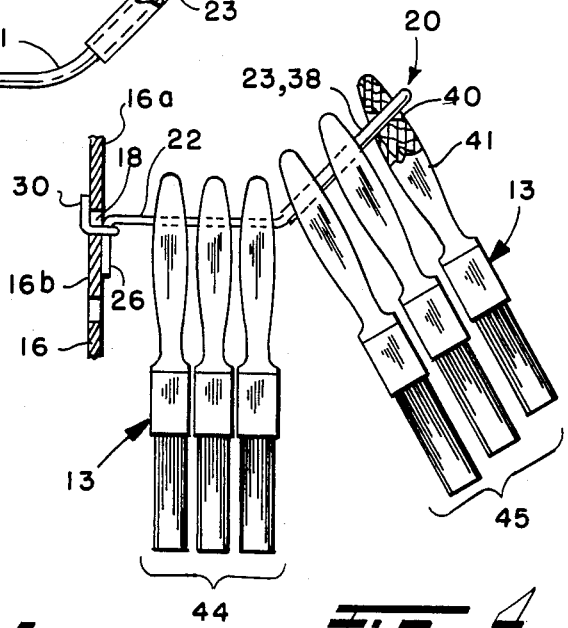
FIG. 4 is a view similar to FIG. 2, but showing the display hanger mounted to an aperture panel and paint brushes supported on the display hanger with one such brush being partly broken away in section.

As seen in FIG. 4, the distance between the front sides of the leg portions 30 and back side of the short leg 26 may be about equal the thickness of the slats 16 while the vertical height of the leg portions 30 is greater than the height of the slots 18. The hanger may be vertically upwardly pivoted to permit insertion of the arm portions 30 through a selected slot 18 and behind the slat 16*a* forming the top wall of the slot. When thusly inserted, the hanger then may be pivoted downwardly with the arm portions engaging the back side of the slat 16*a* and the short leg portion 26 engaging the front side of the slat 16*b* forming the bottom wall of the slot to effect mounting of the hanger to the panel as shown. In such mounted position, the storage portion 22 of the wire body 20 will extend substantially normal to the aperture panel and forwardly from the panel with the storage portion being substantially horizontal and the display portion 23 inclined upwardly in the vertical plane of the storage portion for example at a 45° angle.

As will be appreciated, the arm portions 30 at the attachment end of the hanger, being laterally spaced, will cooperate with the inside top and/or bottom walls of the slot 18 to maintain the upwardly inclined storage portion 23 of the wire body 20 in a vertical plane. The arm portions 30 may also be spaced to coincide with the horizontal spacing between apertures in a pegboard to permit usage of the display hanger with such type of aperture panel commonly employed in many commercial establishments for the display of paint brushes and other articles.

Further in accordance with the invention, the upwardly inclined display portion 23 of the wire body 20 has a covering 38 over substantially the length thereof. The covering 38 preferably is a soft vinyl or rubber coating conveniently applied, for example, by dipping the display portion 23 into a bath of uncured molten vinyl or rubber, the coated display portion then being removed from the bath and the vinyl or rubber cured as in conventional manner to form the soft resilient covering or coating. The covering is adhered or tightly fitted on the display portion to prevent the covering from being pulled off when in use, and has a smooth cylindrical outer surface the diameter of which is desirably slightly less than the diameter of holes in the handles of brushes to be hung from the display hanger.

In use, the display hanger 12 may be mounted to an aperture panel as aforedescribed for storage and display of paint brushes as illustrated in FIGS. 1 and 4. Any brush 13 provided with the usually circular or sometimes oval hole 40 in the handle 41 thereof may be mounted on the display hanger, the covering 38 having a diameter slightly less than the smallest diameter of the hole 40. In this latter regard, it is noted that the holes provided in some commercially available paint brushes have tapered front and rear ends giving the hole a somewhat hourglass cross-sectional shape with the smallest diameter of the hole being located approximately at the center of the thickness of the handle as seen in FIG. 4.

To load the display hanger 12, a number of brushes 13 may be threaded at their handle holes 40 onto the wire body 20 over the covering 38 on the display portion 23 and onto the storage portion 22 from which they may hang in vertical disposition and in front to rear stacked relationship as seen at 44 in FIG. 4. As seen at 45 in FIG. 4, a number of brushes also may be threaded onto the display portion 23 and supported thereon at an upward tilt effected by a wedging or binding action of the covering 38 at the handle hole 40. That is, the weight of the brush once released will cause inside surfaces of the hole to engage and bind against the soft resilient covering on the display portion to hold the brush at an angle to said display portion usually less than 90° but not by a lesser angle exceeding the angle of the display portion to the horizontal. Accordingly, the brushes hung from the display portion of the wire body will be supported in an upwardly inclined and fronted position for easy viewing and removal. The binding action may be attributed to the resilience of the coating, relative to the metal from which the wire body is formed, and/or relatively high coefficient of friction afforded by the soft vinyl or rubber covering. The edges of the handle hole may bite into and/or frictionally engage the covering to provide a secure lock against axial slippage along the display portion and also a holding force against rotation of the brush which prevents the brushes from getting out of alignment once properly set in place on the hanger. It also is noted that the covering 38 covers the front or outer end of the wire body 20 to protect, for example, a customer or employee from injury that might otherwise occur by contact with an exposed wire end.

Since the wire body 20 of the display hanger 12 preferably is formed from ductile wire, the wire body can be adjusted by rebending the body as at 21 to provide on site a desired incline to horizontal of the display portion to allow for different weight brushes, variations in handle hole diameters and variations in the aperture display panels.

In view of the foregoing, it can now be appreciated that there is provided a display hanger which is highly functional yet inexpensive and easy to manufacture and use, for example, with conventionally used aperture panels. The hanger provides for orderly storage and display of paint brushes on the aperture panel with the forwardmost or fronted brushes held upwardly inclined for easy viewing and removal. Brushes with specially formed slots in their handles are not required for use with the display hanger. Also the display hanger embodies a safety feature not afforded by previously used wire hangers.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the following claims.

We claim:

1. A merchandising system for paint brushes or the like comprising: an upstanding aperture panel; at least one display hanger mounted to said aperture panel for hanging support of a plurality of paint brushes or the like from said aperture panel, said display hanger comprising a wire body bent intermediate its length at an acute angle to form a rear article storage portion and an angled front article display portion, said wire body having a rear end, attachment means at said rear end of said wire body for removably yet securely mounting said wire body to the aperture panel at an aperture therein with said storage portion extending substantially horizontally and forwardly from said panel and said display portion upwardly inclined in the vertical plane of said storage portion, each of said storage portion and said display portion being of sufficient length to accommodate and support a plurality of such brushes in axially spaced relation along each such length, and a soft resilient covering on said display portion over substantially the length thereof, said covering being operative to effect a wedging or binding action at a hole in each handle of a plurality of such brushes threaded thereon for holding each such brush upwardly inclined for easy viewing and removal; a plurality of paint brushes hanging in vertical disposition in stacked relationship from said storage portion; and a plurality of additional paint brushes supported on said display portion in stacked relationship at an upward tilt effected by a wedging or binding action of said covering at a hole in each handle of said additional brushes, which hole has a diameter slightly greater than the outer diameter of said covering on said display portion.

2. A merchandising system as set forth in claim 1, wherein said covering is made of vinyl material.

3. A merchandising system as set forth in claim 1, wherein said covering is made of rubber material.

4. A merchandising system as set forth in claim 1, wherein said covering is coated onto said display portion.

5. A merchandising system as set forth in claim 1, wherein said covering covers the front end of said wire body.

6. A merchandising system as set forth in claim 1, wherein said acute angle is about 45°.

7. A merchandising system as set forth in claim 1, wherein said wire body is made of ductile metal.

8. A merchandising system as set forth in claim 1, wherein said storage portion and display portion are about equal in length.

9. A merchandising system as set forth in claim 1, wherein said covering has a smooth cylindrical outer surface.

10. A merchandising system as set forth in claim 1, wherein said covering is of uniform outer dimension over substantially the entire length thereof.

* * * * *